US005549165A

United States Patent [19]

Brooks

[11] Patent Number: 5,549,165

[45] Date of Patent: Aug. 27, 1996

[54] VALVE FOR INFLATABLE PACKER SYSTEM

[75] Inventor: Robert T. Brooks, Houston, Tex.

[73] Assignee: Baker Hughes Incorporated, Houston, Tex.

[21] Appl. No.: 378,734

[22] Filed: Jan. 26, 1995

[51] Int. Cl.[6] ..... E21B 33/127

[52] U.S. Cl. ..... 166/386; 166/129; 166/185; 166/187; 166/323; 166/387

[58] Field of Search ..... 166/387, 187, 166/386, 323, 129, 183, 185, 186

[56] References Cited

U.S. PATENT DOCUMENTS

| | | | |
|---|---|---|---|
| Re. 32,345 | 2/1987 | Wood | 277/34 |
| 2,227,729 | 1/1941 | Lynes | 166/187 X |
| 4,580,632 | 4/1986 | Reardon | 166/186 X |
| 4,653,588 | 3/1987 | White | 166/387 X |
| 4,749,037 | 6/1988 | Christensen | 166/319 X |
| 4,781,249 | 11/1988 | Wood | 166/187 |
| 5,082,062 | 1/1992 | Wood et al. | 166/382 |
| 5,297,634 | 3/1994 | Loughlin | 166/387 |

OTHER PUBLICATIONS

Davis Lynch Catalog, 1991, pp. 28, 29.

*Primary Examiner*—Hoang C. Dang
*Attorney, Agent, or Firm*—Umesh M. Desai

[57] ABSTRACT

A pressure limit valve for well tools where a valve member is moveable between a first closed portion, an open position and a second closed position. A spring for closing the valve is separated from a locking chamber which contains locking elements. The locking elements are located in a locking chamber and are held deactivated by a release sleeve which separates from the valve member in an open position. When the valve moves to the second closed position it is locked by engagement of the locking elements with a stop shoulder. In use between closely coupled inflatable packers, the valve prevents trapped pressure between the packers from affecting operation of the packer valve.

21 Claims, 4 Drawing Sheets

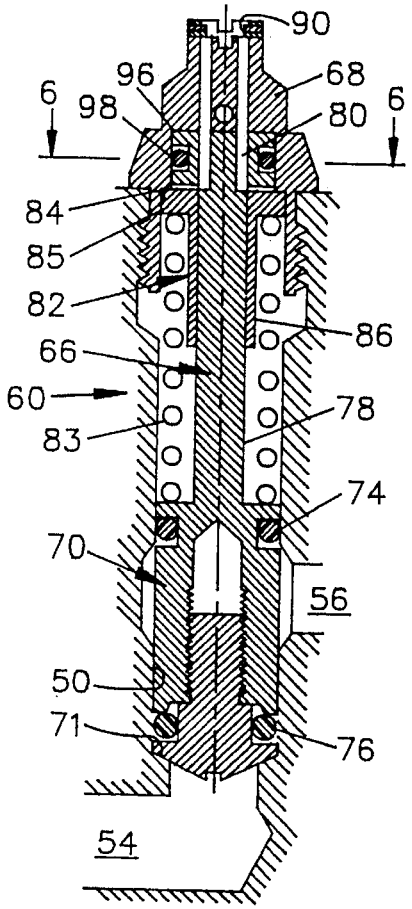
FIG. 4A
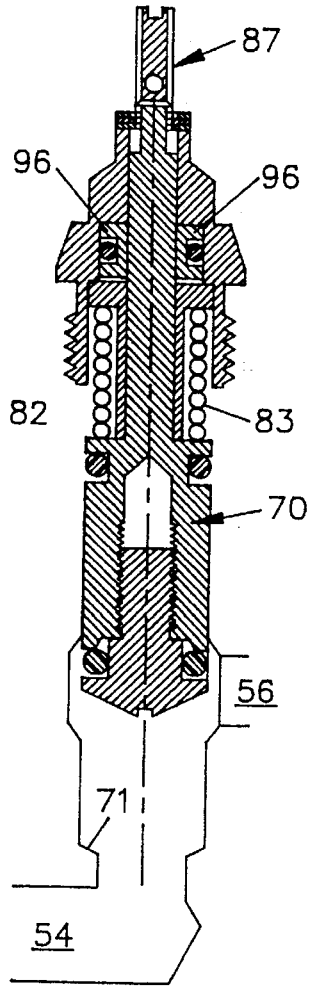
FIG. 4B
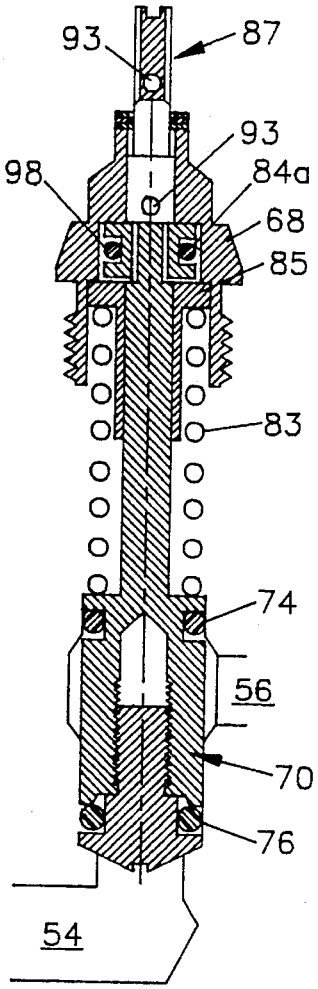
FIG. 4C
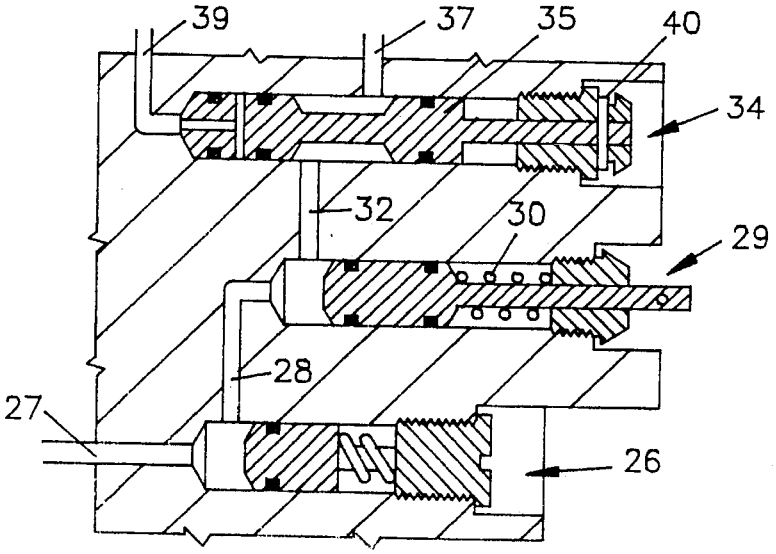
PRIOR ART FIG. 3

VALVE FOR INFLATABLE PACKER SYSTEM

FIELD OF THE INVENTION

This invention relates to valves for use in inflatable packers in a well bore and more particularly, to a system for utilizing a pressure limit valve with an inflatable packer or with closely coupled inflatable packers in an impervious well for controlling pressure differentials to prevent malfunction of an inflatable packer in a well bore.

BACKGROUND OF THE INVENTION

Inflatable packers are commonly used in oil well operations where the inflatable packer is disposed on a string of pipe in a well bore at a desired location. An inflation cement slurry or an inflating fluid is introduced through the string of pipe to a valve system in the inflatable packer. The valve system admits the inflating fluid to the interior of an inflatable packer element. The inflating fluid under pressure expands the packer element into sealing contact with the wall of the well bore.

An inflatable packer element of the type contemplated by the present invention typically will be 20 or more feet in length but may be different lengths in some circumstances. Presently, there are available inflatable packers in 3, 7, 10, 20 and 40 feet lengths which are expandable. Longer packers include an elastomer packing element disposed along a central mandrel where the packing element is progressively expandable from the bottom end of the packer element toward the top end. An inflation valve system is located at the upper end of the packer. If it is desired to run closely coupled inflatable packers, that is, two packers connected end to end or close relationship to one another, a problem can arise if the well bore is impervious, i.e. a casing or a hard rock formation. The inflation of the packer element creates a low volume annular space between the adjacent ends of the packer elements. The packer elements compress the liquid in the annular space and the trapped pressure can increase to a point to cause damage to the formations, the packer elements, and/or the mandrel itself. In certain instances a single packer can be set in a location near the bottom of a well bore where trapped pressure can create an adverse effect.

In still another instance of use, if an inflatable packer is set with one end of the packer element located in an enlarged or washed out section of the bore, damage can occur when the inflation of the packer element occurs in the washed out section. When a packer element is expanded in a washed out section, the element may burst if the inflation pressure rating of the packer is exceeded.

The examples of progressively inflated packer elements may be found in U.S. Pat. No. 4,781,249, issued Nov. 1, 1988; an example of a top mounted inflation valve can be found in U.S. Reissue Pat. No. RE 32345, issued Feb. 3, 1987. An inflation tool for selectively admitting cement slurry to one inflatable packer at a time is found in U.S. Pat. No. 5,082,062, issued Jun. 21, 1992.

SUMMARY OF THE PRESENT INVENTION

The present invention is embodied in a pressure limit valve and its use. The pressure limit valve is responsive to differential pressure to open and to close the valve and has a locking mechanism for retaining the valve in a closed position.

In one form of the invention, the pressure limit valve is located in a pressure valve collar between adjacent ends of inflatable packer elements. The pressure limit valve has a valve element disposed in a valve chamber where the valve element is used to normally close an access bore. The valve element is shear pinned to the normally closed position and a pressure differential across the valve element is used to develop force sufficient to shear the shear pin and move the valve element to an open position opening a flow passage to permit fluid communication between the exterior and the interior of the valve collar.

In moving to an open position, the valve element compresses a spring member and a locking release member on the stem of the valve element is moved from a location under locking elements. The locking elements are semi-circular segments contained in a locking chamber and are resiliently biased inwardly into contact with the locking release member. When the pressure differential across the valve element is decreased below the force of the compressed spring, the valve element is returned to its closed position. In moving to a closing position, the locking release member is separated from the valve stem so that a reduced diameter portion on the valve stem of the valve member is located under the locking elements in the locking chamber which can then lock the valve element in a closed position.

The construction of the valve collar is such that the pressure limit valve is disposed within an axially arranged valve pocket which is located in an internal wall of the pressure valve collar. The valve element moves in response to a differential pressure between a position closing a flow port and opening the flow port to a flow passage. When the valve collar is located between closely coupled inflatable packers, upon inflation of the packer elements, trapped pressure between the packer elements opens the limit valve to relieve the pressure. Subsequently, when the pressure in the bore of the valve collar is relieved the spring member will move the valve to a locking and closed condition.

In another form of the invention, an inflatable packer is provided with a bypass and limit valve to regulate the trapped pressure between adjacent packers. Also, a check valve can be utilized in combination with a limit valve to provide a further control factor.

DESCRIPTION OF THE DRAWINGS

FIG. 1 is a schematic representation of closely coupled inflatable packer elements with a pressure relief collar of the present invention disposed between;

FIG. 3 is a schematic representation of a prior art valve system for an inflatable packer;

FIGS. 4A, 4B, and 4C are, respectively, views of a valve element for use in the present invention in respectively a closed and open, and a locked closed position;

DESCRIPTION OF THE PRESENT INVENTION

Figure 1:
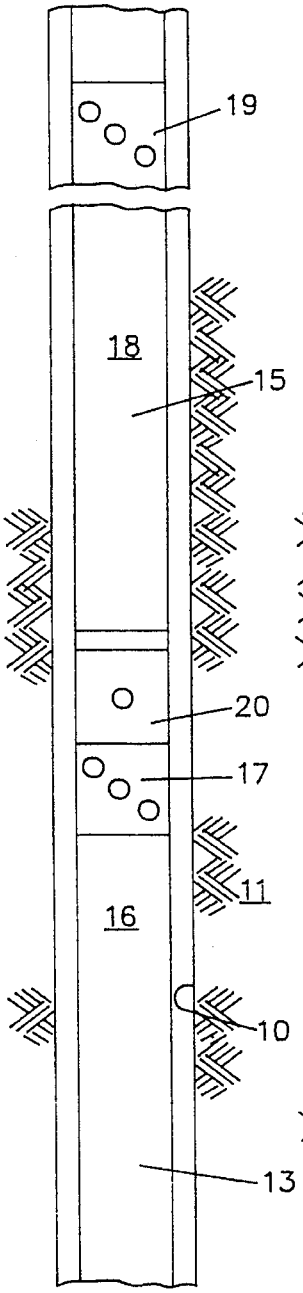

Referring now to FIG. 1, a bore hole 10 traverses earth formations 11 and is impervious to fluid flow by virtue of being either hard rock or cased well bore and it is desired to inflate closely spaced inflatable packers 13 and 15 in the well bore. The lower packer 13 has a packer element 16 and top mounted inflation valve collar 17 and the upper packer 15 has an inflatable packer element 18 and a top mounted inflation valve collar 19. Between the packers 13 and 15 is an a pressure limit valve collar 20.

Figure 2:
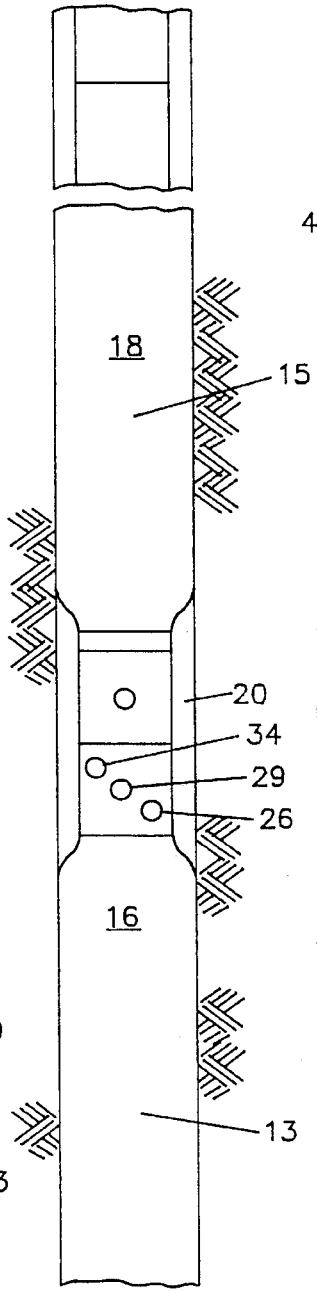
FIG. 2 is a view similar to FIG. 1 but showing the packer elements in partially expanded condition.

In one form of practice, as shown in FIG. 2, after the inflation of the lower packer element 13 with a selective inflation tool (see U.S. Pat. No. 5,082,062) and when the upper packer element 18 is inflated, there is a closed annulus 22 between the packers which contains well bore liquid. The packer inflation is typically from the bottom up (see U.S. Pat. No. 4,781,249) and the inflation of the upper packer 15 compresses the liquid in the short space of the closed annulus 22 and can cause a break down of the formations or a malfunction of the upper packer 13 without use of the limit inflation collar 20 of the present invention. The compression of liquid occurs principally when the reinforcing ribs at the lower end of a packer are expanded. The malfunction of the upper packer 13 is usually a failure to seal properly due to incomplete inflation to a predetermined pressure.

Referring briefly now to FIG. 3, a typical valve system for an inflatable packer includes a check valve 26 which is disposed in a flow passage 27 from the bore of the central mandrel of the inflatable packer. The check valve 26 is spring biased and closes when the spring force is greater than the applied force of fluid pressure. The check valve 26 is connected by a passage 28 to a shear valve 29. The shear valve 29 functions when the force developed by applied pressure shears a shear pin at a predetermined pressure value and opens this normally closed valve. The valve 29 is closed at the completion of the inflation operation in response to force developed by differential pressure and a spring member 30. The closing differential pressure occurs when the pressure on the inflating fluid is relieved. The shear valve 29 is connected by a passageway 32 to a inflation control valve 34, which has a spool valve element 35 connected by passageways 37 and 38 to the internal space between the inflatable packer element and the supporting mandrel for the packer element. When inflation fluid is introduced via the valves 26 and 29 to the valve 34, the fluid is passed to the packer element via the passageway 37. The pressure developed in the inflatable packer element is also applied to the end of the valve element 35 via the passageway 39. When the pressure differential between the internal pressure in the packer element and the pressure external to the packer develops a sufficient pressure differential, a shear pin 40 in the valve 34 is sheared. When the shear pin 40 shears, the control valve 34 is moved to a closed condition trapping the inflation fluid in the inflatable element. This prevents over inflation of the packer element. The valve 34 is held closed by the fluid pressure in the inflatable packer element. The valve 34, therefore, serves to control the pressure that can be applied to the packing element below the collar. This feature effectively prevents over inflation and a rupture of a packer element.

In the forgoing valve system, the check valve 26 and the shear valve 29 can be interchanged so that the shear valve 29 opens to the flow passage 27 and the check valve opens to the passage 28. In this arrangement the check valve is pressure balanced.

Figure 5:
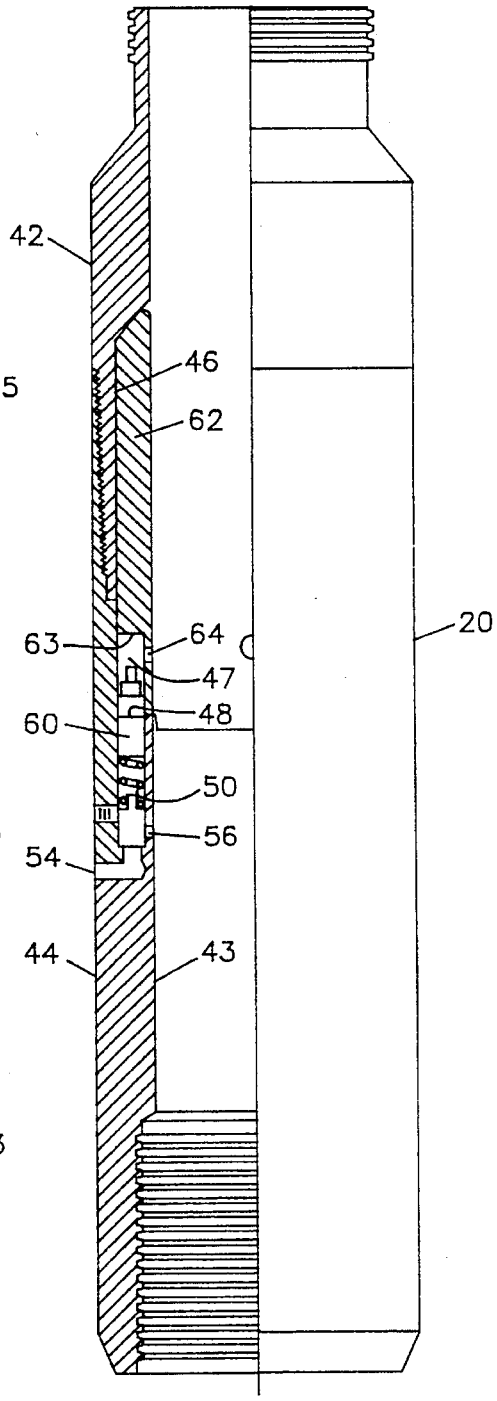
FIG. 5 is a view in partial cross-section of a pressure relief collar according to the present invention.

In the limit valve of the present invention, the valve collar 20 as shown in FIG. 5 includes a housing formed by upper and lower threadedly connected tubular members 42 and 44 which are threadedly connected to one another and define an interior recess 47 relative to the bore 43 of the collar. The internal recess 47 has a shoulder 48 located in the side wall of the lower member 44. A valve chamber 50 extends axially in the side wall of the lower member 44. The chamber 50 has a lower end which opens at 54 to the exterior of the lower member 44 and the valve chamber 50 has an internal side port 56 which opens to the recess 47 in the lower member 44. Disposed in the valve chamber 50 is a limit valve 60 of the present invention. A tubular isolator member 62 is disposed in the recess 46 between the upper and lower members 42 and 44 and has a reduced diameter portion 63 with bores or openings 64 located above the upper end of the valve 60. The isolator member 62 basically encloses the valve 60 in the wall of lower member 44 and defines an annular chamber with the recess 47.

The limit valve 60, as shown in FIGS. 4A–4C, includes a cylindrically shaped valve member 66 located in the valve chamber 50 where the valve chamber 50 has its lower open end to the exterior 54 to the valve housing and has a side port 56 to the interior bore of the valve housing. The valve chamber 50 at its upper end is threaded to threadedly received a tubular valve cap 68. The valve member 66 has a valve element 70 which is slidably disposed in the valve chamber 50 and has spaced apart seal elements 74 and 76 for straddling the side port 56 to the interior bore of the lower member 44.

In a closed position, as illustrated, the end of the valve element 70 seats on a valve seat 71. The lower valve element 70 is connected to a reduced diameter valve stem 78. At the very end of the valve stem 78 is another reduced diameter locking stem portion 80. The valve stem 78 is slidably received within a tubular spacer member 82 which is located in a stepped recess 84 in the valve cap 68. The spacer member 82 has a tubular extension 86 extending downwardly into the valve chamber 50 from a base portion 85 located in the valve cap 68. The stepped recess 84 and the base portion 85 define an annular locking chamber in the valve cap and define an annular spring chamber which extends into the valve chamber 50. The length of the tubular extension 86 is such that it limits the upward travel of the valve element 70 and protects a spring member 83 from distortion within the chamber 50. The shoulder of the recess 84 in the valve cap 68 prevents upward movement of the spacer member 82. Semi-annular segments 96 are located in the locking chamber **84*a* between the base portion 85 of the spacer member 82 and another shoulder in the stepped recess 84** as discussed hereafter.

The spring member 83 disposed between the base portion 85 of the spacer member 82 and the valve element 70 normally biases the valve element 70 to a position engaging the valve seat 71 and closing the port 54 from communication with the port 56.

Figure 8:
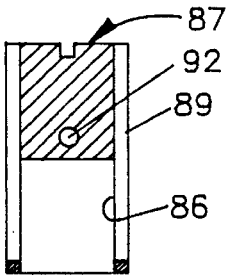
FIG. 8 is a view in longitudinal cross-section through a release sleeve member.

The locking stem portion 80 on the valve member 66 slidably receives bore 86 (see FIG. 8) of a cylindrically shaped lock release member 87. The release member 87 has diametrically arranged longitudinally extending slots or keyways 88 aligned relative to keys or internal projections 90 in the valve cap 68. The upper end of the release member 87 is solid in cross-section and has a transverse opening 92 for a shear pin. The opening 92 is alignable with an opening 93 in the valve cap 68. The shear pin when interconnected between the valve cap member 68 and the release member 87, requires a predetermined force to shear and thereby permit the valve to open.

Figure 6:
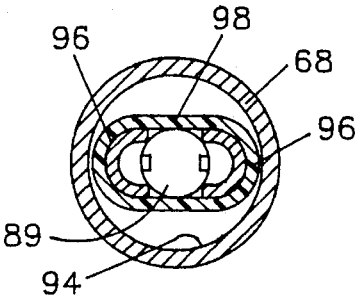
FIG. 6 is a view in cross-section taken along line 6—6 of FIG. 4A.

The locking chamber 84*a* in the valve cap 68 located between an internal shoulder in the valve cap 68 and the base portion 85 of the tubular spacer member 82 defines an annular locking recess or chamber which contains two semi-cylindrical or semi-annular segments 96 (see FIG. 6) which engage the outer surface of the lock release member 87. The inner curvature of the segments 96 is complementary to the curvature of the locking stem portion 80 and the inner curvature is less than the curvature of the release member 87 so that the segments 96 are separated from one another by the release member 87. When the release member 87 is removed from under the segments 96, the segments 96 can move to form an annular ring. In the outer surface of the segments 96 is circumferential groove. An O-ring 98 is disposed in the groove in the segments 96 and resiliently biases the segments against the outer surface of the lock release member 87. The segments 96 in the locking chamber 84*a* are separated from the spring member 83 and its effects.

While the limit valve 60 of the present invention has a number of applications, it is advantageous to use in the valve system in a valve collar located between a closely coupled set of inflatable packers. The packers are disposed in a well bore which is highly impervious to liquid. The lower packer is inflated first by a selective inflation tool. Next, the upper packer inflation is commenced.

In operation, the limit valve has a shear pin of the desired strength located in the shear pin opening 93 of the valve cap and the opening 92 of the release lock member 87. When the trapped pressure reaches a predetermined pressure, the shear pin is sheared by pressure in the port 54 and the pressure is applied to the end of the valve element 70. The shear pin operates at a lower pressure than the shear pins in the inflation control valve in an inflatable packer to insure that the limit valve opens before the inflation control valve is operated. The valve element 70 moves to an open position in response to pressure and the exterior of the valve collar is placed in fluid communication with the bore of the collar valve through the communication of the ports 54 and 56 in the valve. The pressure applied to the end of the valve element 70 is the trapped pressure between two inflatable packers. When the valve element 70 moves to an open position as shown in FIG. 4B, the spring 83 is compressed and the locking release element 87 is extended outwardly of the end of the cap member 68. The travel of the valve element 70 is limited by engagement with the spacer member 82 to protect the spring 83 from distortion and the spacer member 85 separates the spring from the locking segments 96. Thus, the force of the spring is isolated from the locking segments 96 in the locking chamber 84*a*.

When the valve is open, pressure in the annulus between the packer elements is vented to the bore of the collar through the valve so long as it over comes the spring force thus, a pressure buildup between packers will not occur. The pressure in the bore of the collar is in the column of fluid below the inflation tool. When the pressure inside of the bore 43 of the limit valve collar 20 is decreased relative the pressure in the annulus (after the inflation of the upper packer), the spring member 83 acts on the valve element 70 to move the valve element 70 to its closed position, as shown FIG. 4C. In this position, the locking release element 87 is separated and released from the locking stem portion 80 and is retained in the upper most position of the bore in the valve cap 68. The reduced diameter locking stem portion 80 on the valve stem 78 is disposed between the locking segments 96 which are resiliently biased by the O-ring 98 to close on the recess locking stem portion 80. The locking segments in the locking chamber 84*a* have end shoulders which can engage the base portion 85 of the spacer element 82 and the shoulder in the valve cap 86 and prevent axial movement of the valve element from the closed position. The operative shoulder on the valve stem engages an end shoulder of the locking segments and jams the locking segments against the base portion of the spacer member.

Figure 9:
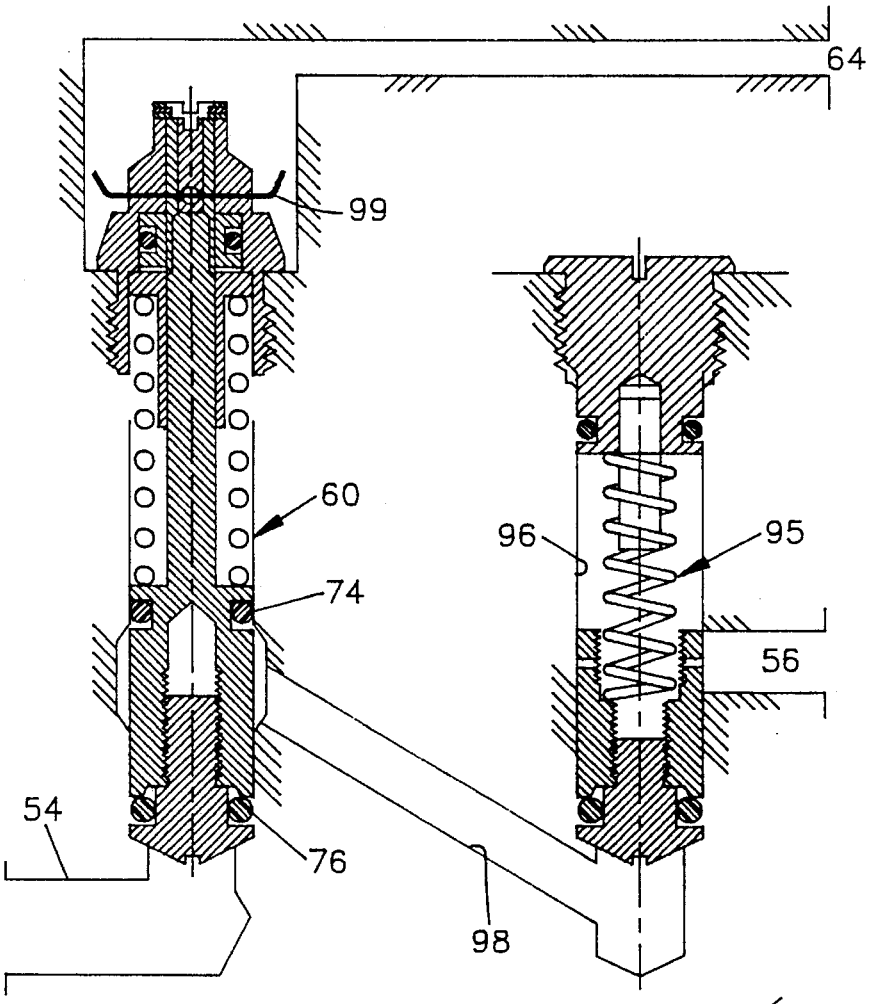
FIG. 9 is a view in partial cross-section of a modification of the present invention.
Figure 7:
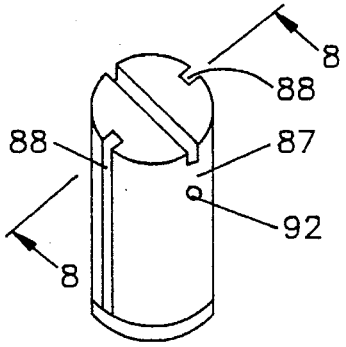
FIG. 7 is a perspective view of a release sleeve member.

Referring now to FIG. 9, a limit valve 60 can be disposed in a valve collar where the port 56 to the interior of the valve collar is coupled to a check valve 95 disposed in a valve chamber 96 where the valve chamber 96 is connected by a flow passage 98 to the valve member 70 at a location intermediate of the seals 74 and 76. The check valve 95 is spring biased to close off the passage 98. When the pressure in the port 54 exceeds the strength of the shear pin 99, the valve 60 opens as described above. The pressure then opens the check valve 95 and the port 56 is in fluid communication with the port 54 and vents pressure from the annulus to the bore.

When the pressure in the port 56 is relieved below the pressure in the port 54, the springs in the check valve and in the limit valve close the valves. When the check valve 95 is closed pressure can be applied in the bore of the valve collar to the port 64 to positively assure the closure of the limit valve. The check valve 95 prevents pressure from the bore through port 56 from being applied to the limit valve 70. It can be appreciated that with use of the check valve, the spring 83 can be omitted if desired. When the check valve is closed, reverse flow from the annulus can not occur.

Figure 10:
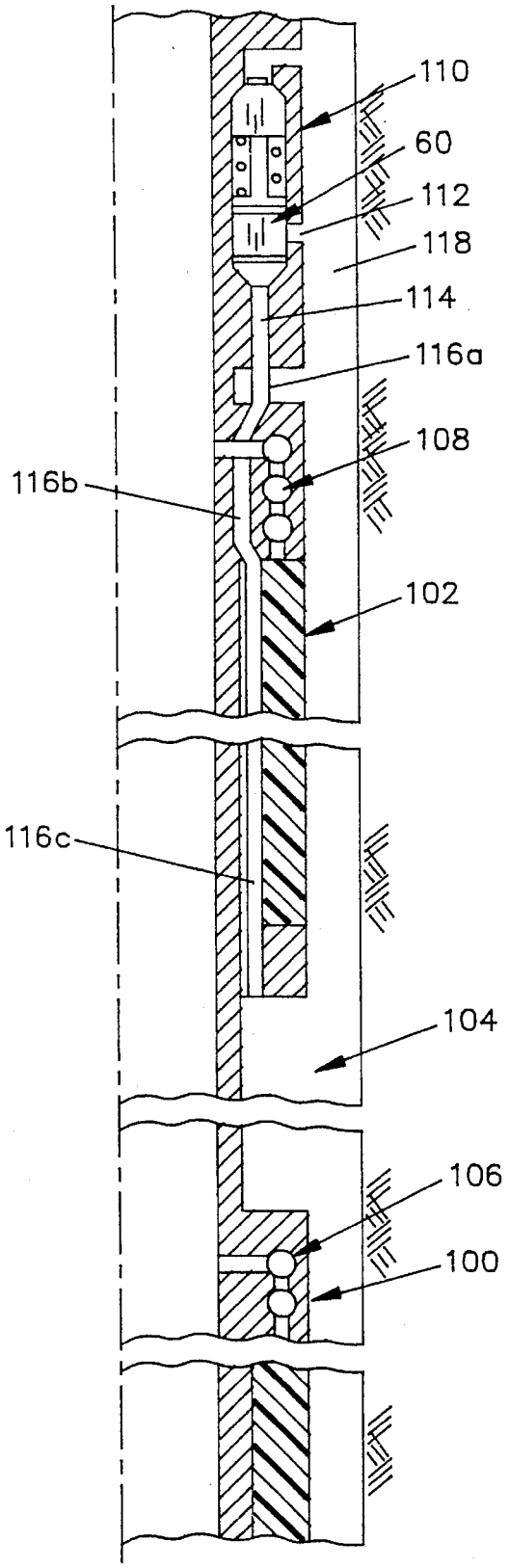
FIG. 10 is a schematic illustrated in partial longitudinal cross-section of tandem connected inflatable packers with a valve collar embodying the present invention.
Figure 11:
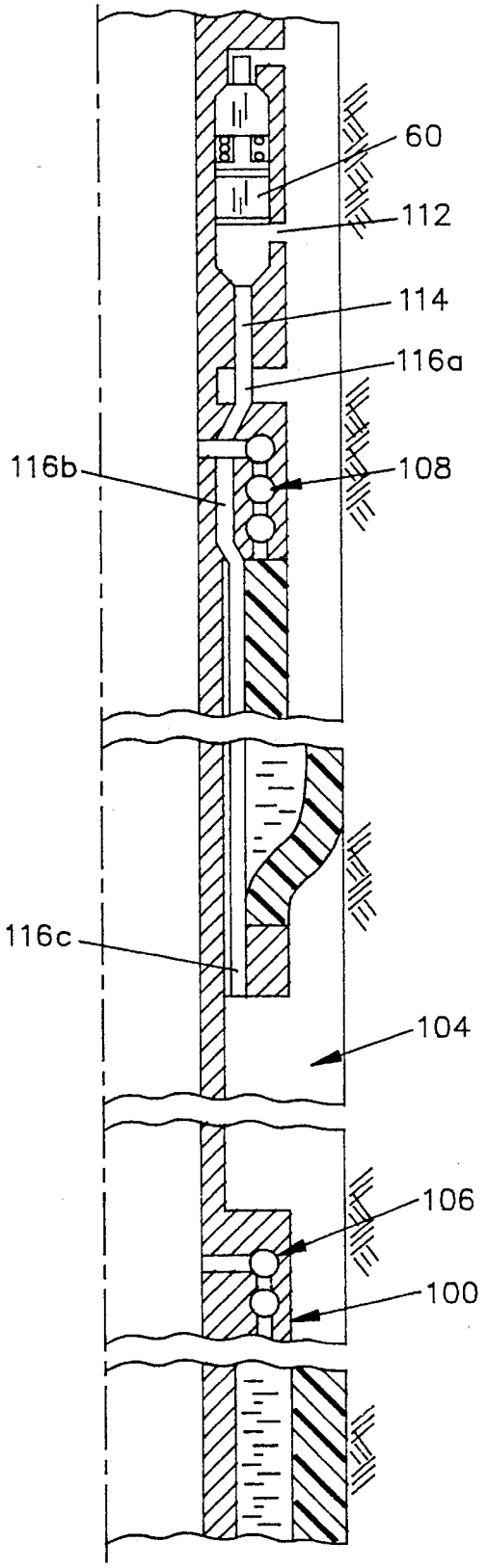
FIG. 11 is a view similar to FIG. 10 but showing the packers under inflation conditions with the valve in operation for relieving trapped pressure between the packers.

Referring now to FIGS. 10 and 11, another form of the present invention is illustrated. In this arrangement, the lower inflatable packer is connected in a closely coupled relationship to the upper inflatable packer. A "closely coupled relationship" is defined as a spacing and sizing of inflatable packers relative to a well bore such that an undesirable or excessive pressure can be trapped between the two packers. Also, the inflation fluid for the packer can include mud or cement.

As shown in FIG. 10, an annular space 104 exists between the two packers. Each packer has an valve inflation system 106 and 108 (see FIG. 3) which controls the packer inflation. In this form of the invention the packers can be inflated sequentially or simultaneously. Above the upper packer 102 is a valve collar 110 which has a limit valve 60. The valve collar 110 has a outlet 112 opening to the annulus in the well bore above the upper packer. The port 114 to the valve 60 is coupled by a piping system 116*a*, 116*b* and 116*c* to the annular space 104. The piping system 116*a*, 116*b*, and 116*c* provides a flow conduit to couple the annular space 104 to the annulus 118 above the upper packer.

When the packers are inflated, liquid trapped in the space between the packers is vented to the inlet of the limit valve 60. This pressure opens the valve 60 when the shear pin and spring in the valve 60 are overcome by the force developed by the pressure. When the valve 60 opens the trapped pressure is vented to the annulus above the upper packer.

It will be apparent to those skilled in the art that various changes may be made in the invention without departing from the spirit and scope thereof and therefore the invention is not limited by that which is disclosed in the drawings and specifications but only as indicated in the appended claims.

I claim:

1. A limit valve for limiting the pressure differential between an interior of a valve collar and an exterior of the valve collar comprising:

a collar member having a valve chamber where said valve chamber has an inlet port and an outlet port;

a valve member slidably disposed in said valve chamber for moving between a first closed position where said ports are not in fluid communication, an open position where said ports are in fluid communication, and a second closed position where said ports are not in fluid communication;

a tubular valve cap member for closing said valve chamber and having a cap member bore for slidably receiving a stem element on said valve member, a tubular spacer member disposed in said valve cap member and having a spacer member bore for slidably receiving said stem element, said spacer member and said valve cap member defining a locking chamber recess in said valve cap member and defining a spring chamber which opens to said valve chamber;

a spring means in said spring chamber for resiliently engaging said valve member and for moving said valve member to a closed position;

said stem element having a reduced locking stem portion disposed in said locking chamber recess in said first closed position;

a release member slidably disposed on said locking stem portion in said first closed position and sized to be slidably received in said cap member bore, said release member being separable from said locking stem portion in the open position of the valve member;

locking segments disposed in said locking recess;

resilient means cooperating with said locking segments for engaging said locking elements with the release member in said first closed position and for engaging said locking segments with the locking stem portion in said second closed position; and shear means interconnecting said valve member and said cap member in said first closed position for maintaining said valve closed until a differential pressure between the inlet port and the outlet port operates the shear means to move the valve member to an open position, said valve member being returnable to the second closed position by the spring means and locked in the second closed position by the locking segments when the differential pressure is sufficiently relieved relative to the forces of the spring means.

2. The valve as set forth in claim 1 wherein said segments have an inner wall curvature which is complementary to the outer wall curvature of said locking stem portion.

3. The valve as set forth in claim 2 wherein said segments have a circumferential groove in an outer wall and said resilient means is a O-ring.

4. The apparatus as set forth in claim 1 wherein said valve collar is a tubular member and said valve chamber is located in the wall of said valve collar and said inlet port and said outlet port open to the exterior and the interior of said valve collar.

5. The apparatus as set forth in claim 4 wherein said valve collar is a tubular member comprised of interconnected tubular parts which define a central interior recess and wherein said valve chamber is located in an axial direction in the wall of said valve collar with said inlet port opening to the exterior of the tubular member and the outlet port opening to the interior of said tubular member, a tubular isolator member disposed in said recess for enclosing said valve and for accessing the tubular cap member to the interior of said tubular member.

6. The apparatus as set forth in claim 1 and further including two closely coupled inflatable packers where the valve collar is located between the packers and is set to operate the shear means interconnecting the valve member and the cap member at a predetermined differential pressure so that pressure trapped between the packers can be vented to a lower pressure zone.

7. A method for controlling the pressure between two inflatable packers in a well bore containing a well liquid comprising the steps of:

inflating a packer element on each of the packers in a well bore with a first liquid under a first pressure to trap the well liquid between the inflatable packers;

venting the well liquid between the inflatable packers which exceeds a predetermined pressure to the bore of a valve collar located between the inflatable packers with a valve to prevent excessive trapped pressure between said inflatable packers from exceeding said predetermined pressure, causing incomplete inflation of one or both inflatable packers; and reducing pressure in said valve collar and closing the valve in the valve collar.

8. The method as set forth in claim 7 including the steps of:

inflating the packers selectively with a liquid supplied from the earth's surface to said packer elements, and venting the annulus well liquid to the bore of the valve collar.

9. The method as set forth in claim 7 wherein there is a valve collar located above the inflatable packers with a valve for venting the liquid and including the steps of:

inflating the packers and venting the annulus well liquid to the annulus above the upper packer.

10. In a well tool for use in a well bore where a differential pressure can be developed in the annulus about the well tool and in the bore of the well tool, the improvement comprising:

a valve chamber in said well tool arranged and constructed for fluid communication with the annulus and the bore with inlet and outlet ports;

a valve member disposed in said valve chamber and movable between a first closed position where said ports are not in fluid communication, an open position where said ports are in fluid communication and a second closed position where said ports are not in fluid communication;

means in said valve chamber for defining a locking chamber and a spring chamber, said valve member having a valve stem extending through said locking chamber and said spring chamber;

spring means in said spring chamber for resiliently urging said valve member toward a closed position;

locking means in said locking chamber for engaging a shoulder on said valve stem in said second closed position for locking said valve member in said second closed position;

sleeve means on said valve stem in engagement with said shoulder in said first closed position while separating said locking means from said valve stem, said sleeve means being slidably disposed on said valve stem so that it can be separated from said shoulder in said open position;

resilient means acting on said locking means for engaging said valve stem and said shoulder in said second closing position; and shear means for maintaining said valve member in said closed first position until a differential pressure between the inlet port and the outlet port operates the shear means to move the valve member to an open position, said valve member being returnable to the second closed position by the spring means and locked in the second closed position by the locking means when the differential pressure is sufficiently relieved relative to the forces of the spring means.

11. The well tool as set forth in claim 10 wherein said locking means includes segments which have an inner wall curvature which is complementary to an outer wall curvature of a locking portion of the valve stem.

12. The well tool as set forth in claim 11 wherein said segments are semi-annular and have a circumferential groove in an outer wall and further including said resilient means for resiliently urging said segments to a locking condition.

13. The well tool as set forth in claim 12 wherein said valve chamber is in a tubular member comprised of interconnected tubular parts which define a central interior recess and wherein said valve chamber is located in an axial direction in the wall of said tubular member with said inlet port opening to the exterior of the tubular member and the outlet port opening to the interior of said tubular member, a tubular isolator member disposed in said recess for enclosing said valve chamber and for accessing the valve chamber to the interior of said tubular member.

14. The apparatus as set forth in claim 10 and further including two closely coupled inflatable packers where the valve chamber in the well tool is located between the packers and is set to operate the shear means at a predetermined differential pressure so that pressure trapped between the packers can be controlled.

15. The apparatus as set forth in claim 10 and further including two closely coupled inflatable packers where the valve chamber in the well tool is located above the packers and is set to operate the shear means at a predetermined differential pressure so that pressure trapped between the packers can be vented.

16. In a well tool for use in a well bore where a differential pressure can be developed in the annulus about the well tool and in the bore of the well tool, the improvement comprising:

a valve chamber in said well tool arranged and constructed for providing fluid communication path between the annulus and the bore, said communication path having inlet and outlet ports;

a valve member disposed in said valve chamber and movable between a first closed position where said ports are not in fluid communication, an open position where said ports are in fluid communication and a second closed position where said ports are not in fluid communication;

means in said valve chamber for defining a locking chamber, said valve member having a valve stem extending through said locking chamber;

locking means in said locking chamber for engaging a shoulder on said valve stem in said second closed position for locking said valve member in said second closed position;

sleeve means on said valve stem in engagement with said shoulder in said first closed position while separating said locking means from said valve stem, said sleeve means being slidably disposed on said valve stem so that it can be separated from said shoulder in said open position;

resilient means acting on said locking means for engaging said valve stem and said shoulder in said second closing position;

check valve means disposed in said communication path for preventing reverse flow of liquid after said valve member is in said second closed position; and shear means for maintaining said valve member in said closed first position until a differential pressure between the inlet port and the outlet port operates the shear means to move the valve member to an open position, said valve member being returnable to the second closed position by differential pressure and locked in the second closed position by the locking segments when the differential pressure is sufficiently relieved.

17. The well tool as set forth in claim 16 wherein said locking means includes segments which have an inner wall curvature which is complementary to an outer wall curvature of a locking portion of the valve stem.

18. The well tool as set forth in claim 17 wherein said segments are semi-annular and have a circumferential groove in an outer wall and further including said resilient means for resiliently urging said segments to a locking condition.

19. The well tool as set forth in claim 16 and further including means for defining a spring chamber in said valve chamber where said valve stem extends through said spring chamber and a spring means located in said spring chamber; said spring means assisting the movement of said valve member between said open position and said second closed position.

20. The apparatus as set forth in claim 16 and further including two closely coupled inflatable packers where the valve chamber in the well tool is located between the packers and is set to operate the shear means at a predetermined differential pressure so that pressure trapped between the packers can be controlled.

21. The apparatus as set forth in claim 16 and further including two closely coupled inflatable packers where the valve chamber in the well tool is located above the packers and is set to operate the shear means at a predetermined differential pressure so that pressure trapped between the packers can be vented.

* * * * *